United States Patent [19]

Schaefer et al.

[11] 4,388,961

[45] Jun. 21, 1983

[54] STRIP-TYPE DOOR

[75] Inventors: Horst Schaefer, Gomaringen-Stockach; Hans Votteler, Reutlingen, both of Fed. Rep. of Germany

[73] Assignee: Albert Reiff KG, Reutlingen, Fed. Rep. of Germany

[21] Appl. No.: 227,409

[22] Filed: Jan. 22, 1981

[30] Foreign Application Priority Data

Oct. 21, 1980 [DE] Fed. Rep. of Germany ..... 3039594

[51] Int. Cl.[3] ..... A47H 1/00

[52] U.S. Cl. ..... 160/332

[58] Field of Search ..... 160/184, 332, 395, 235; 49/397; 16/128.1, 149, 171, 172

[56] References Cited

U.S. PATENT DOCUMENTS

| | | | |
|---|---|---|---|
| 1,406,303 | 2/1922 | Tomkinson | 160/235 |
| 1,521,045 | 12/1924 | Poyas | 160/184 |
| 2,549,110 | 4/1951 | Michael | 49/397 |
| 3,592,256 | 7/1971 | Knight | 160/184 |
| 4,033,396 | 7/1977 | Thomasset | 160/184 |

*Primary Examiner*—Peter M. Caun

*Attorney, Agent, or Firm*—Michael J. Striker

[57] ABSTRACT

A strip-type door having a plurality of individual strips arranged in overlapped relationship one to another comprises a series of swingable supports on which the individual strips are vertically suspended when the latter take a vertical position. A mounting element connected to a lintel over the door opening has a mounting portion, a supporting bar and an arcuate wall defining an arcuate channel. Each of the supports is formed with a curved portion insertable into the channel in the mounting element to form with this wall a hinge about which the supports carrying the individual strips can swing relative to the mounting element between a plurality of positions. The curved end portion may be inserted into said channel in only one of these positions so that the inadvertent falling or removal of the supports out of the channel when the strips are in their working swingable positions is prevented.

3 Claims, 6 Drawing Figures

STRIP-TYPE DOOR

BACKGROUND OF THE INVENTION

The present invention pertains to strip-type doors, and more particularly to means for mounting individual strips having faces overlapping each other on a lintel over the door opening.

A strip-type door normally comprises a number of individual strips made of flexible plastic synthetic material, which strips are vertically suspended on a series of swingable supports swingably connected to the lintel over the door opening. In the known constructions, a swingable support is provided with a supporting sleeve having two portions which are positioned on a supporting tube secured to the lintel of the door opening. In order to mount or dismount the strips of the strip-type door from the lintel, two halves of sleeve-type swingable supports must be positioned on the supporting tube together or separately one from another so as to enable one to mount on or remove the swingable support from the supporting tube. Such mounting and dismounting have been found considerably expensive, especially in the relatively high and large constructions of the door.

SUMMARY OF THE INVENTION

It is therefore an object of the invention to provide an improved strip-type door.

Another object of the invention is to provide a strip-type door with a plurality of individual strips which avoids by simple means the aforementioned shortcomings encountered in the prior art.

Still another object of the invention is to provide a strip-type door where the individual strips are easily assembled or dismantled from a lintel over a door opening.

Yet another object of the invention is to provide a construction of the strip-type door where a danger of falling of individual strips out of the door lintel is completely avoided.

These and other objects of the invention are attained by a strip-type door comprising a plurality of individual strips having faces positioned to overlap each other, said strips being formed of plastic synthetic material, a series of swingable supports connected to said strips so that the strips are vertically self-suspended on the supports, and a mounting element secured to a lintel over the door opening. The mounting element has a channel spaced from the lintel and in part bounded by an arcuate wall portion. Each of said supports is provided with a curved portion insertable into said channel to form with said wall portion a hinge about which the supports can swing relative to said mounting element between a plurality of positions. The curved portion of each of the supports is insertable into said channel in only one of said positions to prevent falling of said supports out of the channel when the strips are in their working swingable positions.

The individual strips of the strip-type door of the invention may have upper rims, said supports being connected to said rims.

Each of the supports may include a recess to receive said upper rims of the strips.

The mounting element may include a mounting portion, a supporting bar and an arcuate wall portion forming the channel, said supporting bar connecting the mounting portion and the arcuate wall portion. The mounting portion itself may be secured to a lintel over the door opening.

The curved portion of the support may be terminated with an end section having a spiral shape.

The arcuate wall portion may have an edge which is spaced from the mounting portion of the mounting element at a predetermined distance, the spiral shape of the end sections may be so formed that when the curved portion is inserted into said channel in said only one position the outer dimension of the end section to be inserted into said channel is at most equal to said predetermined distance whereas the remaining outer dimensions of the end section are greater than said predetermined distance. In other words, the end portion has such a spiral shape that in all the working swingable positions of the strips this predetermined distance remains smaller than the outer dimensions of the spiral the end portion of the supporting member. According to the invention the removal or inadvertent falling of the individual strips out of the channel in the mounting element is possible only in one predetermined position of the supporting member in the channel. The construction suggested herein prevents the supports carrying the strips from removal from the mounting element in all the remaining positions of the swingable strips. Therefore, according to the invention, the reliable mounting of the strips on the lintel of the door opening is provided. The undesirable removal of the strips from the supporting channel of the mounting element is completely prevented in any working swingable position of the strips.

Each of the supports may include an upper section, a bent intermediate section and a lower section. The upper section in such case is terminated with said curved portion, said intermediate portion interconnecting the upper and the lower sections, and the lower section being provided with a recess which receives the upper rims of the strips. The upper and lower sections of the support may be positioned in a common plane.

The curved portion may further include a circular portion, and a straight portion, said circular portion merging into said straight portion, said straight portion merging into said end section to form a curve of a predetermined shape, said channel being formed of a shape matching with said curve to form the hinge with the arcuate wall of the supporting element.

The mounting element may include a number of rollers carrying the supporting bar of the mounting element. These rollers serve for removal of the mounting element from the lintel of the door.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
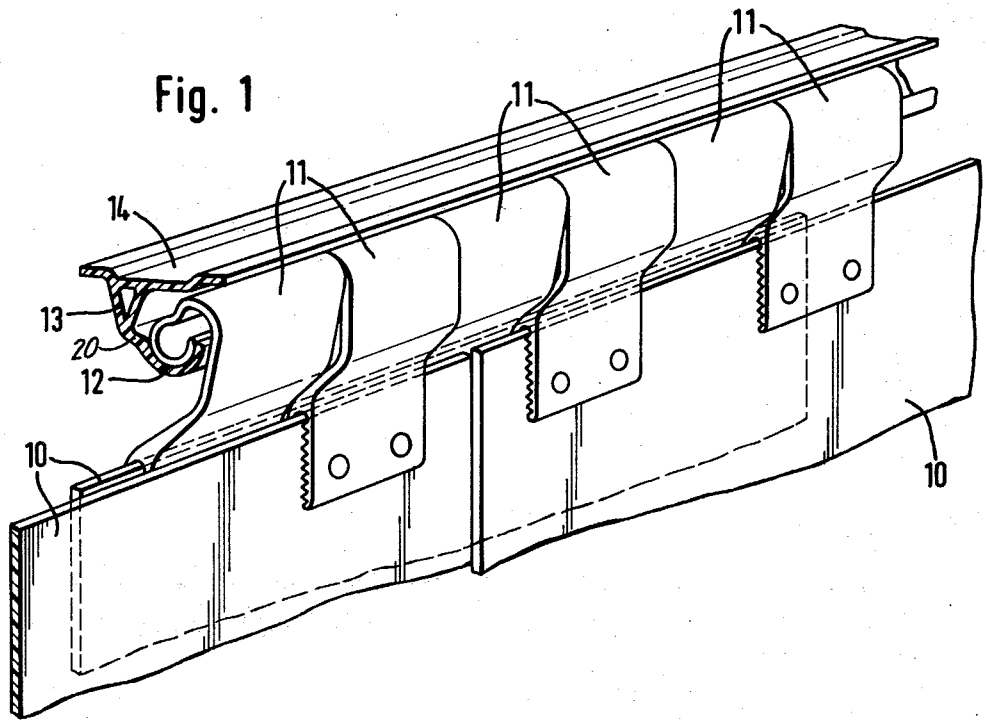
FIG. 1 is a partial perspective view of a strip-type door according to the invention.
Figure 3:
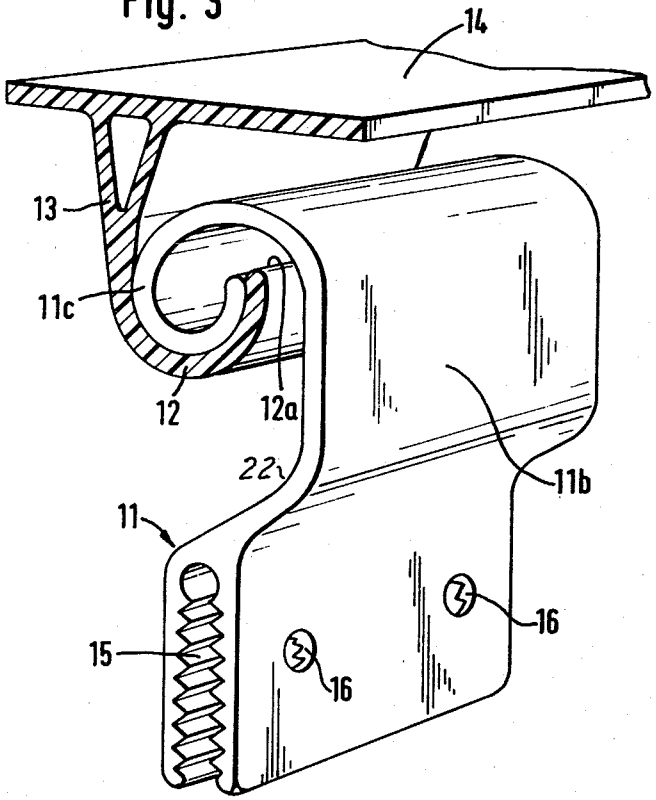
FIG. 3 shows an enlarged partial view of the swingable support shown in FIG. 2 in its assembled position.

Referring now to the drawing, and first to FIG. 1, a strip-type door includes a number of successively positioned strips 10 (three strips are shown in FIG. 1) the faces of which overlap one another. The strips may be made of synthetic plastic material or any other suitable material. A number of swingable supporting members 11 are provided in the assembly to connect strips 10 to a mounting element 14 which in turn is secured on a lintel over the door opening not illustrated herein.

The mounting element 14 is formed with an arcuate end wall 20 having a channel 12 for receiving the upper portions of the supporting member 11. As can be clearly seen from FIG. 1, one series of members 11 are connected to one group of strips 10, whereas another series of the supporting members 11 support the group of strips overlapping the first group. The strips 10 are positioned so that their upper narrower sides are suspended on the supporting members 11. The mounting element 14 is formed with a double-walled supporting bar 13 merging into the arcuate end wall 20.

FIGS. 2–6 illustrate various forms of support members 11 in the various positions relative to the channel 12.

Figure 4:
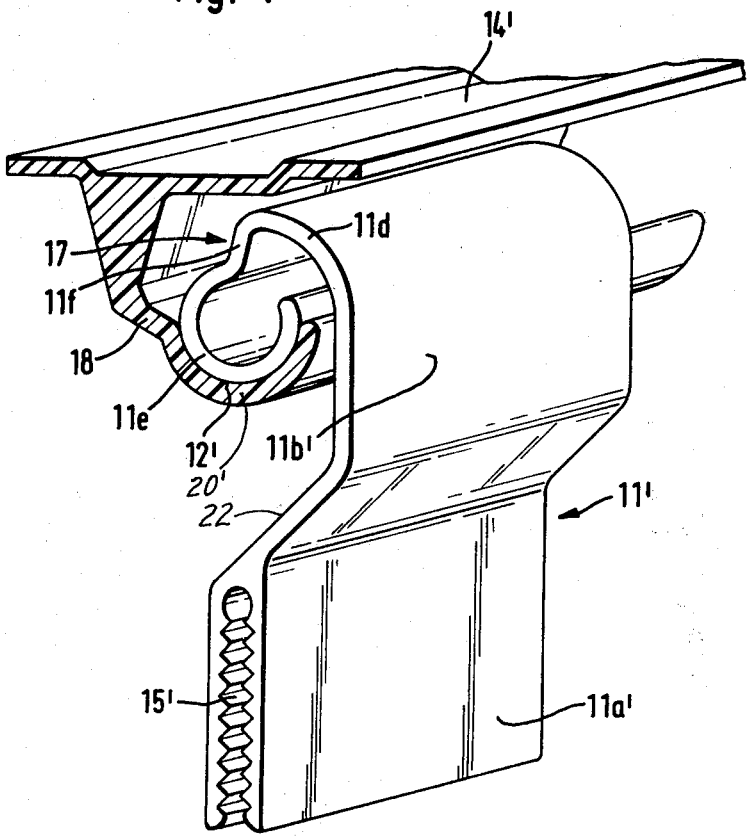
FIG. 4 illustrates an enlarged view of the support of a second embodiment of the invention.

The support member 11 includes a relatively flat upper portion **11*a* (11*b*' in FIG. 4) and a relatively flat lower portion 11*b* (11*a*' in FIG. 4). These upper and lower portions of the supports 11 are interconnected with a bent transition portion 22. The lower portion 11*a* is double-walled and formed with a recess 15 (15') having teeth on the inner surfaces thereof. In assembling the strips 10 are slidably inserted into the recess 15 from the lateral side thereof. The strips are then rigidly clamped to the members 11 by means of non-illustrated conventional fastening means such as screws, rivets or the like. The screws or rivets penetrate through the synthetic plastic material of the strips 10 at the upper borders thereof and reliably secure the strips on the supporting members 11**.

Figure 2:
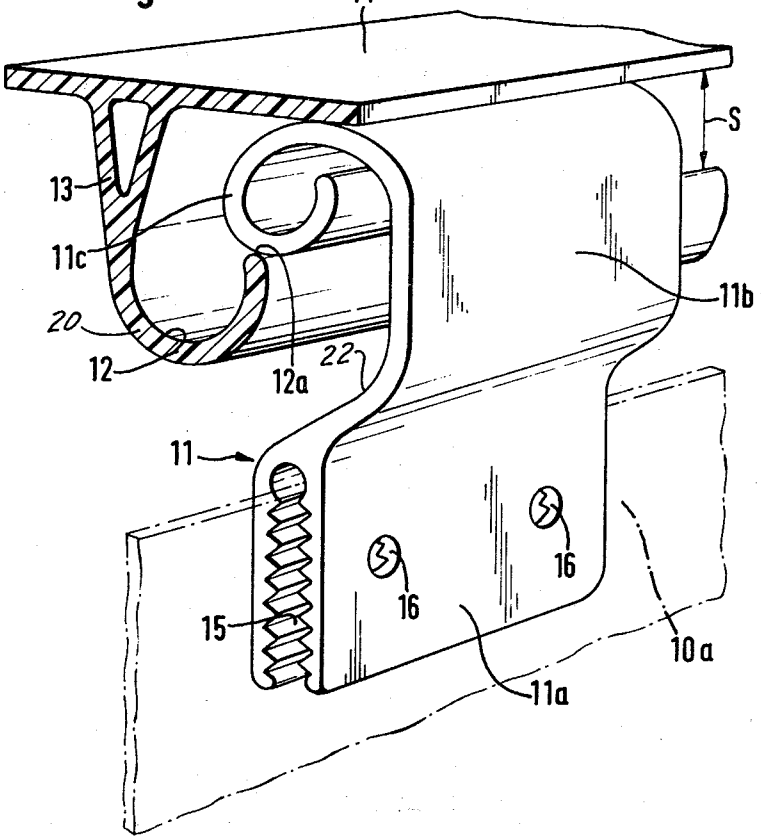
FIG. 2 illustrates an enlarged partial view of the first embodiment of the invention, where a swingable support is shown in the position in which it is prepared to be inserted into a channel formed in a mounting element of the door.

FIG. 2 shows the first embodiment of the support member 11 in which the upper portion **11*b* is formed with a curved end section 11*c*. The member 11 depicted in FIG. 2 is shown in the position where it is prepared to be inserted into the channel 12. It is to be understood that member 11 must be held in a vertical position to be inserted into the channel of the mounting element 14**. The purpose of such installation will be explained in detail below.

The curved end section **11*c* of the supporting member 11 has a substantially helical shape. This helically-shaped end portion is inserted into the channel 12 and in assembly forms a hinge with the arcuate wall 20 of the mounting element 14. It is to be understood that the profile of the channel 12 corresponds to the outer surface of the curved end portions 11*c*. By provision of the helical shape of the end portion 11*c* the latter has various outer dimensions in each angled position. The helical shape of the end portion 11*c* is so selected that the member 11 may be inserted into the channel 12 only in one certain position, namely in the position when member 11 takes its vertical position with respect to the mounting element 14. The vertical position of the element 11 is depicted in FIG. 2 corresponds to the rest position of the strips connected to the supporting member 11. In order to insert supporting member 11 into the channel 12, the latter must be so positioned that the curved end portion 11*c* will be able to be pushed through a clearance S between the mounting element 14 and the edge of the arcuate portion 20. Such installation is possible when the curved end portion 11*c* is inserted into the clearance S by its smallest outer diameter. After the end portion 11*c* has been inserted into the channel 12 through the clearance S, the supporting member 11 takes such a position that in all swingable positions thereof the outer diameter of the curved portion 11*c* exceeds the clearance S. Thus, falling of the support members 11 carrying the strips 10 during working swingable positions of the latter is completely prevented, since the outer size of the helically shaped curved portion 11*c* prevents the supporting members 11** from falling out from the assembly.

Figure 5:
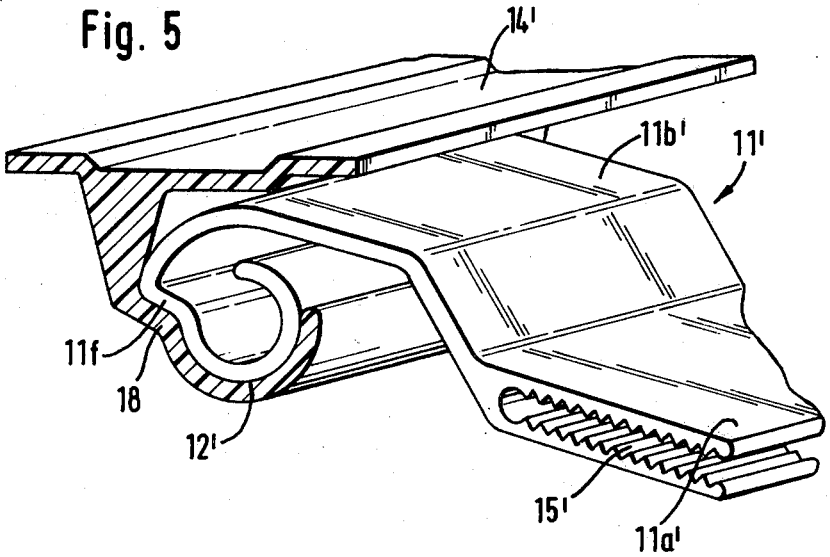
FIG. 5 is an enlarged partial view of the support of FIG. 4 in one of its swinging positions when the support faces away from the mounting element.
Figure 6:
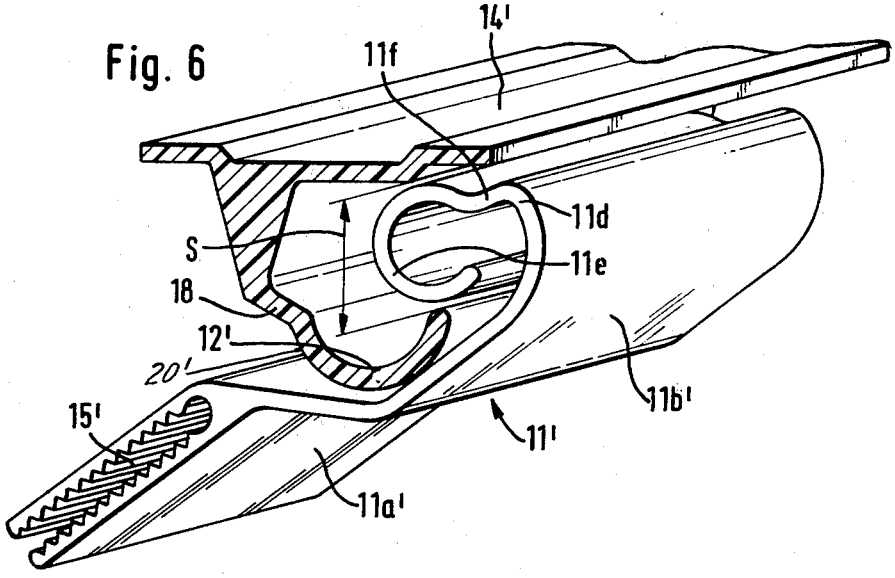
FIG. 6 is an enlarged partial view of the support shown in FIG. 4 in the position in which the support is shown before it is inserted into the channel of the mounting element.

FIGS. 4–6 illustrate another embodiment of the mounting assembly according to the invention. In this embodiment the supporting element 11 is formed with a first circular portion **11*e*, a straight transition portion 11*f* and a second circular or helically-shaped portion 11*e* which is inserted into the channel 12' of the mounting element 14'. The transition portion 11*f* is formed as a shoulder 17 which serves to interconnect two circular portions one to another. The mounting element 14' in this embodiment is formed with an end curved wall 22' which has a shape matching with the shape of the curved portion of the supporting member 11'. A recess 15' is provided in the lower portion of the supporting member 11' which serves to receive a strip suspended on the supporting member 11'. FIG. 6 illustrates the position of the supporting member 11' in which the latter is inserted into the channel 12' to the clearance S'. As clearly seen in FIG. 6 the supporting member 11' is in one of its swingable positions where the curved portion 11*e* is pushed through the clearance S' by its smallest outer dimension. In order to insert the supporting member 11' through the clearance S' the member 11'** must be so deflected that the curved end portion at its smallest diameter should be positioned against clearance S'.

FIG. 5 illustrates one of the swingable positions of the supporting member 11' in which the curved portion **11*e* and the straight portion 11*f* abut against the inner surface of the wall 12'. Both of the embodiments of the present invention clearly show that the end curved portion of the supporting member may be inserted or removed from the channel provided in the mounting element in only one of the positions of the supporting member 11**.

The mounting element 14 or 14' illustrated in the above-discussed Figures has an upper plate serving to connect the mounting element to the lintel of the door opening. A number of rollers may be employed in the assembly instead of the upper plate of the mounting element. The rollers, not illustrated herein, may be arranged in engagement with a rail mounted on the lintel over the door opening and are commonly known, and they serve to remove the whole assembly from the door when desired.

It will be understood that each of the elements described above, or two or more together, may also find a useful application in other types of strip-type doors differing from the types described above.

While the invention has been illustrated and described as embodied in the strip-type door, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A strip-type door, comprising a plurality of individual strips having faces positioned to overlap each other, said strips being formed of plastic synthetic material and having upper rims; a series of swingable supports each including a recess to receive a respective upper rim of said strips and connected therewith; and a mounting element having a mounting portion secured to a lintel over the door opening, an arcuate wall portion, a channel spaced from the lintel and in part bounded by the arcuate wall portion and a supporting bar connecting said mounting portion with said arcuate wall portion, each of said supports including an upper section formed with an inwardly curved portion terminated with an end section of a spiral shape and insertable into said channel to form with said arcuate wall portion a hinge about which the supports can swing relative to said mounting element between a plurality of positions, a bent intermediate section and a lower section, said intermediate section interconnecting said upper and lower sections, said lower section being provided with said recess, said arcuate wall portion of the mounting element having an edge being spaced from said mounting portion thereof at a predetermined distance, said inwardly curved portion of each of said supports having such a shape and outer dimensions that said inwardly curved portion of each of said supports may be inserted into said channel in only one of said positions in which the outer dimension of the inwardly curved portion is at most equal to said predetermined distance whereas the remaining outer dimensions of said inwardly curved portion are greater than said predetermined distance, to thereby prevent falling of said supports out of said channel when the strips are in their working swingable positions.

2. The door of claim 1, wherein said lower section has two walls forming said recess, one of said walls and the edge of said end section being positioned in a common plane.

3. The door of claim 1, wherein said curved portion further includes a circular portion and a straight portion, said circular portion merging into said straight portion, said straight portion merging into said end section to form a curve of a predetermined shape, said channel being formed of a shape matching with said curve to form said hinge with said arcuate wall.

* * * * *